US007414641B2

(12) United States Patent
Sasaki et al.

(10) Patent No.: US 7,414,641 B2
(45) Date of Patent: Aug. 19, 2008

(54) METHOD OF MANUFACTURING THERMAL HEAD

(75) Inventors: Tsuneyuki Sasaki, Fukushima-ken (JP); Hirotoshi Terao, Fukushima-ken (JP)

(73) Assignee: Alps Electric Co., Ltd, Tokyo (JP)

( * ) Notice: Subject to any disclaimer, the term of this patent is extended or adjusted under 35 U.S.C. 154(b) by 89 days.

(21) Appl. No.: 11/614,857

(22) Filed: Dec. 21, 2006

(65) Prior Publication Data

US 2007/0146468 A1 Jun. 28, 2007

(30) Foreign Application Priority Data

Dec. 27, 2005 (JP) ..... 2005-376466

(51) Int. Cl.
*B41J 2/335* (2006.01)

(52) U.S. Cl. ..... 347/205

(58) Field of Classification Search ..... 347/198, 347/197, 176, 220, 208, 209, 205; 400/120.16, 400/120.17
See application file for complete search history.

(56) References Cited

U.S. PATENT DOCUMENTS 5,223,855 A * 6/1993 Ota et al. ..... 347/209
5,367,321 A * 11/1994 Shigenori et al. ..... 347/208
7,256,809 B2 * 8/2007 Goto et al. ..... 347/198

FOREIGN PATENT DOCUMENTS

JP 3-236231 10/1991

* cited by examiner

*Primary Examiner*—K. Feggins
(74) *Attorney, Agent, or Firm*—Brinks Hofer Gilson & Lione

(57) ABSTRACT

Both ends of a head substrate in a longitudinal direction warp in a direction away from a cross section of a print substrate (in the convex shape) when a sealing resin is cured. A central portion of the head substrate in a longitudinal direction warps in a direction away from the cross section of the print substrate (in the concave shape) when heating elements emit heat. A curing condition when curing the sealing resin is changed corresponding to the concave-shaped warpage occurring when the heating elements emit heat, such that the convex-shaped warpage of the head substrate occurring when the sealing resin is cured is offset by the concave-shaped warpage of the head substrate and thus the heating elements are arranged in a straight line when the heating elements emit heat at the time of printing.

3 Claims, 4 Drawing Sheets

METHOD OF MANUFACTURING THERMAL HEAD

This application claims the benefit of Japanese patent application No. 2005-376466, filed on Dec. 27, 2005, which is incorporated herein by reference.

TECHNICAL FIELD

The present application relates to a method of manufacturing a thermal head, and in particular, to a method of manufacturing a line-type thermal head which is mounted on a thermal transfer printer.

BACKGROUND

A method of manufacturing a thermal head in the related art will now be described with reference to a thermal head disclosed in JP-A-05-069575, for example. As shown in FIG. 7, a plurality of heating elements 22 are arranged on a head substrate 21 in a longitudinal direction (a row direction of printing) of the head substrate 21.

A method of manufacturing the thermal head includes forming a plurality of heating elements 22 in the longitudinal direction by using a photolithographic technique. In this case, a central portion of the plurality of heating elements 22 is bent downward from both ends of the heating elements 22 by a warpage amount of 't'. The warpage amount of 't' corresponds to the warpage amount of a platen roller 23, which will be described later, occurring at the time of printing.

The head substrate 21 is provided on a head mounting member (not shown) made of, for example, aluminum having an excellent heat-radiating property.

The platen roller 23 presses an ink ribbon and record paper (not shown). As shown in FIG. 8, the platen roller 23 is provided on the heating elements 22 which are bent. The platen roller 23 includes a friction member 23*a*, such as a rubber cylinder, and a slender mandrel 23*b*, which is inserted into the center of rotation of the friction member 23*a* and is rotatably supported by a printer (not shown).

While the platen roller 23 presses the record paper and ink ribbon on the heating elements 22 at the time of printing, the central portion of the platen roller 23 rotating counterclockwise is bent to the direction of arrow C by friction between the record paper and the friction member 23*a* as shown in FIG. 8.

Since the thermal head in the related art includes the heating elements 22 of the head substrate 21 which are bent by a warpage amount of 't', the platen roller 23 may uniformly press the ink ribbon and record paper on the heating elements 22 by pressure even though the platen roller 23 is bent to the direction of arrow C at the time of printing.

However, since the thermal head in the related art includes a plurality of heating elements 22 which are bent by a warpage amount of 't', a curved line is printed along the heating elements 22 when the heating elements 22 emit heat at the same time. Accordingly, the heat emission of the heating elements 22 is controlled to correspond to the curve of the heating elements 22 by a driver IC (not shown) in order to print a straight line. However, it is very difficult to control the heat emission by means of the driver IC.

Further, when the head substrate 21 of the thermal head is narrow in width 'A', the head substrate 21 is partially thermally expanded by the heat of the heating elements 22 which occurs at the time of printing, such that the central portion of the head substrate 21 warps to the direction of arrow B (called 'banana warpage').

As a result, even though a plurality of heating elements 22 is bent by a warpage amount of 't' before emitting heat, the head substrate 21 may be bent to a direction opposite to that of the heating elements 22 when the heating elements 22 emit heat at the time of printing, and the platen roller 22 may not be uniformly pressured to the heating elements 22.

SUMMARY

A method of manufacturing a thermal head having a long head substrate is described on which a plurality of heating elements is arranged in a longitudinal direction and includes: mounting a control unit on a print substrate so as to control heat emission of the heating elements; and, covering the control unit, a cross section of the print substrate, and a cross section of the head substrate with a sealing resin when the print substrate and the head substrate are mounted on a head mounting member and the cross section of the print substrate and the cross section of the head substrate are in contact with each other. Both ends of the head substrate in a longitudinal direction are warped in a direction away from the cross section of the print substrate (in the convex shape) when the sealing resin is cured. A central portion of the head substrate in a longitudinal direction is warped in a direction away from the cross section of the print substrate (in the concave shape) when the heating elements emit heat. A curing condition when curing the sealing resin is changed corresponding to the concave-shaped warpage occurring when the heating elements emit heat, such that the convex-shaped warpage of the head substrate occurring when the sealing resin is cured is offset by the concave-shaped warpage of the head substrate and thus the heating elements are arranged in a straight line when the heating elements emit heat at the time of printing.

In the method of manufacturing a thermal head, the curing condition of the sealing resin may be obtained by changing a resin material, a coating amount, heating temperature, or heating time, or using a combination thereof, such that the curing condition of the sealing resin is changed corresponding to the amount of the concave-shaped warpage of the head substrate occurring when the heating elements emit heat, the amount of the concave-shaped warpage of the head substrate being known.

In addition, in the method of manufacturing a thermal head, the curing condition of the sealing resin may be set such that the amount of the concave-shaped warpage of the head substrate occurring when the sealing resin is cured is in a range of 20 to 60 μm.

DETAILED DESCRIPTION

Exemplary embodiments may be better understood with reference to the drawings, but these embodiments are not intended to be of a limiting nature. Like numbered elements in the same or different drawings perform equivalent functions.

Figure 1:
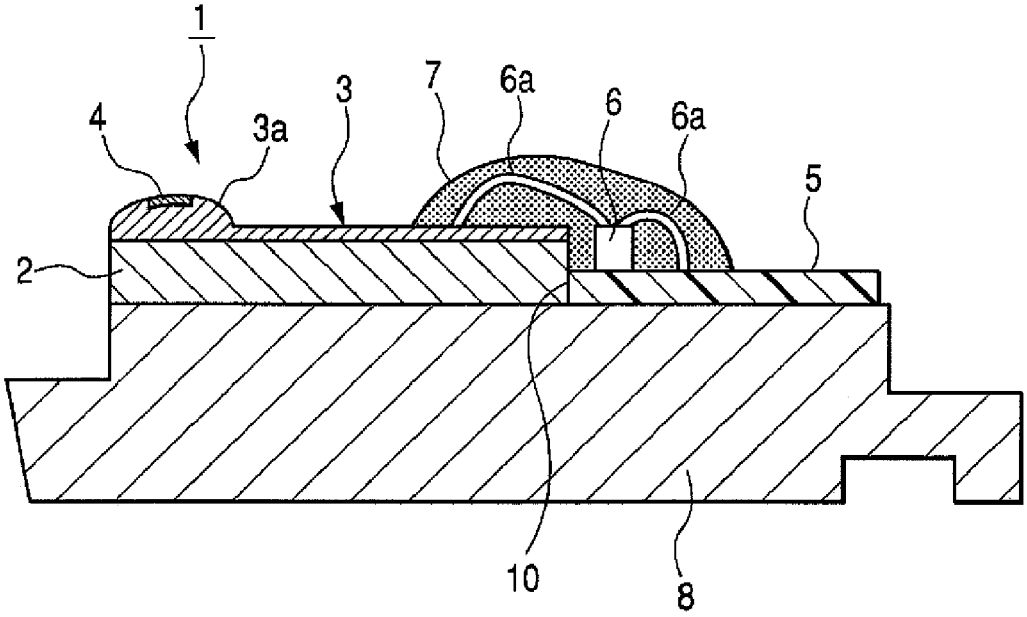
FIG. 1 is a cross-sectional view illustrating main parts of a thermal head according to an embodiment.
Figure 2:
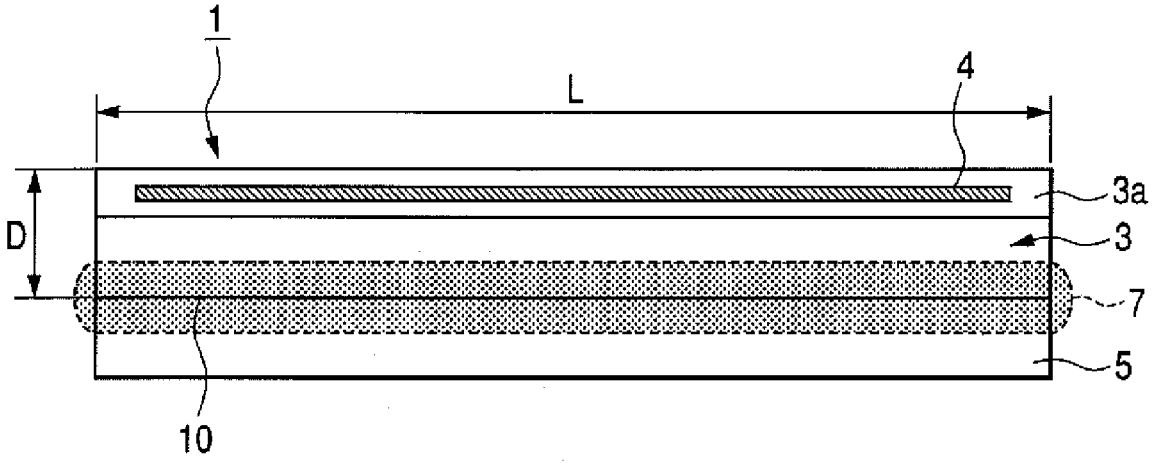
FIG. 2 is a plan view schematically illustrating a head substrate.
Figure 3:
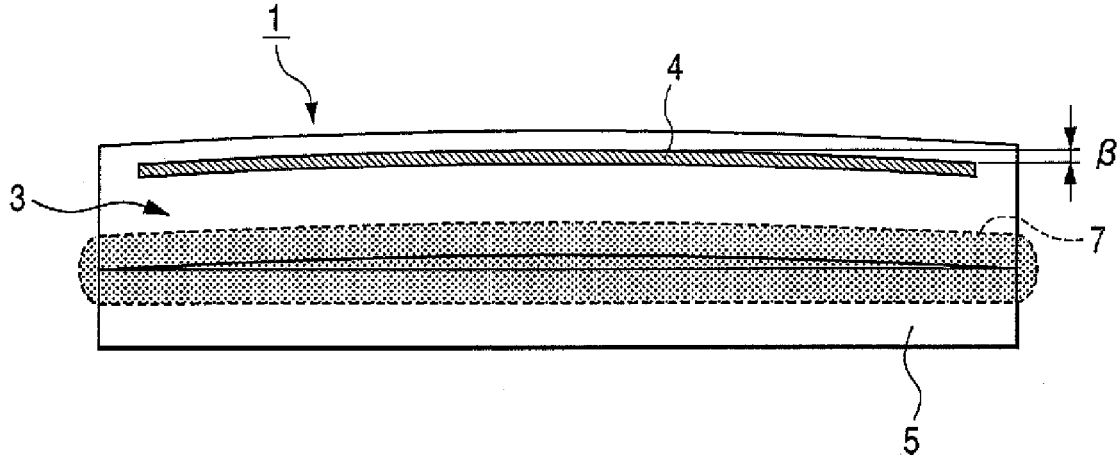
FIG. 3 is a plan view schematically illustrating warpage of a head substrate.
Figure 4:
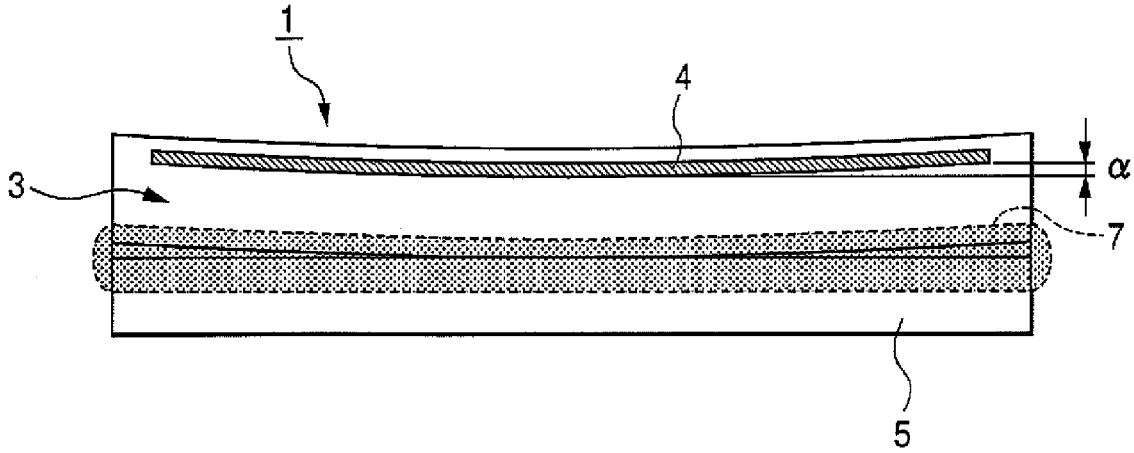
FIG. 4 is another plan view schematically illustrating warpage of a head substrate.
Figure 5:
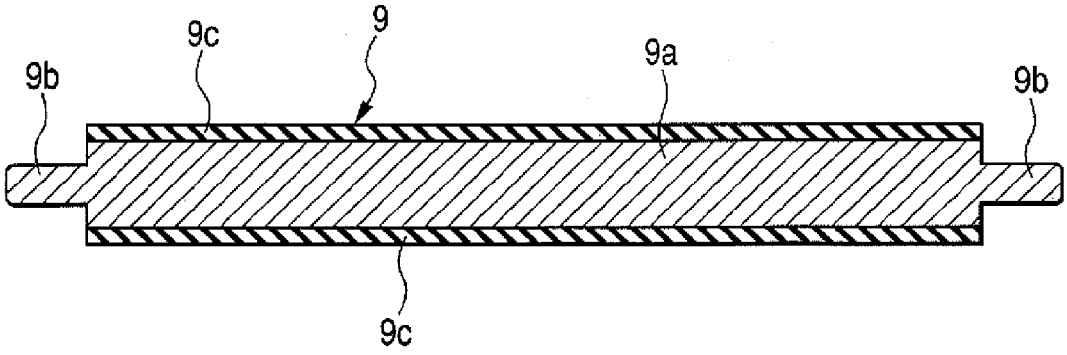
FIG. 5 is a cross-sectional view illustrating main part of a platen roller.
Figure 6:
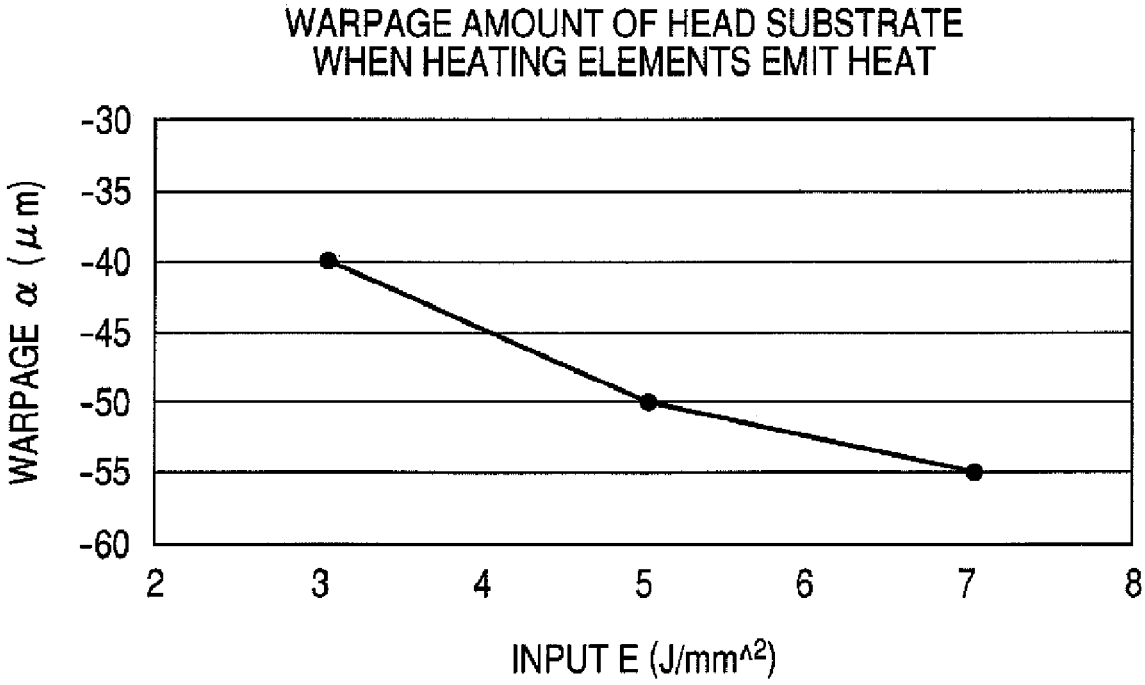
FIG. 6 is a graph illustrating the warpage amount of a head substrate.
Figure 7:
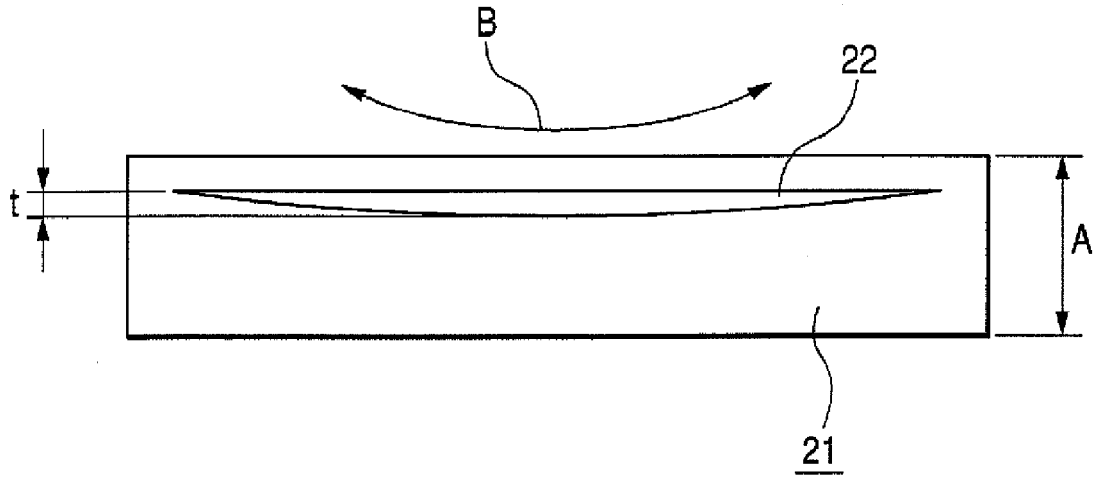
FIG. 7 PRIOR ART
FIG. 7 is a view schematically illustrating a thermal head in the related art.
Figure 8:
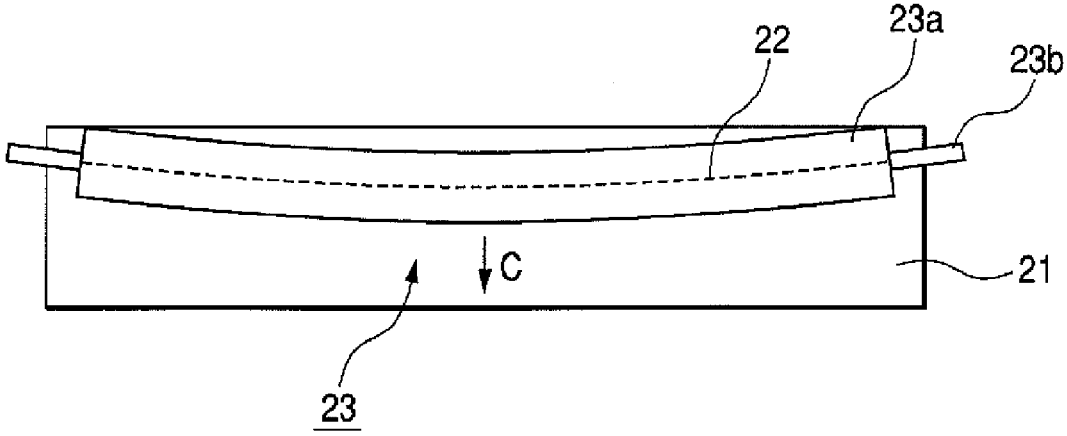
FIG. 8 PRIOR ART
FIG. 8 is a view schematically illustrating a print state in the thermal head in the related art.

FIG. 1 is a cross-sectional view illustrating main parts of a thermal head. FIGS. 2 to 4 are plan views schematically illustrating warpage of a head substrate. FIG. 5 is a cross-sectional view illustrating main parts of a platen roller. FIG. 6 is a graph illustrating the warpage amount of a head substrate.

As shown in FIG. 1, a thermal head 1 includes a head substrate 2 made of ceramic and a thermal layer 3 formed on the head substrate 2, which are provided in a direction orthogonal to a support. A projecting part 3*a* is formed in an arc shape on the left side of the thermal layer 3 along the longitudinal direction of the thermal layer 3. A plurality of heating elements 4 formed of resistors is arranged in line along the longitudinal direction of the projecting part 3*a*.

As shown in FIG. 2, the head substrate 2 has a longitudinal rectangular shape. In addition, a width D of the head substrate 2 is about 3 mm, which is narrow so as to correspond to a small-sized printer (not shown), and a length L of the head substrate 2 is about 100 mm.

The heating element 4 is interposed between a common electrode (not shown) and an individual electrode, which are respectively formed on left and right sides of the drawing.

A print substrate 5 is provided on the right of the head substrate 2 so as to be in contact with the head substrate 2. A control unit 6 is provided on the print substrate 5 to be close to the head substrate 2 and is formed of a driver IC to selectively control a plurality of heating elements.

The control unit 6 is connected to a lead 6*a* made of, for example, copper or aluminum, and the lead 6*a* is wire-bonded to the individual electrode and an electric power supply trace (not shown) of the print substrate 5.

The control unit 6 and the lead 6*a* are covered by a sealing resin 7 which is made of a thermosetting resin having an epoxy resin as a main ingredient.

A head mounting member 8 made of a heat-radiating material, such as aluminum, is provided on the head substrate 2 and the print substrate 5, thereby forming the thermal head 1.

A cylindrical platen roller 9 can be pressed against the heating element 4 through an ink ribbon and record paper.

As shown in FIG. 5, the platen roller 9 includes a main body 9*a* and supporting shafts 9*b*, which may be unitarily formed with each other. The main body 9*a* is made of metal and is shaped like a thick shaft. The supporting shaft 9*b* is provided on both ends of the main body 9*a* and is shaped like a thin shaft. The main body 9*a* is covered with a friction member 9*c* made of a high-friction material, such as rubber, such that a record paper pressed against the heating element 4 can be moved without slippage.

Since the platen roller 9 is configured such that the main body 9*a* is thicker than the supporting shaft 9*b*, the platen roller 9 is not warped even though it is strongly pressed to the thermal head 1 at the time of printing.

The thermal layer 3 is formed on the head substrate 2. The thermal layer 3 may be made of glaze by sputtering and photolithography. A plurality of heating elements 4 is formed on the projecting part 3*a* along the longitudinal direction of the head substrate 2 by photolithography.

The head substrate 2 and the print substrate 5 are placed in contact with each other and are fixed on the head mounting member 8 by adhesives. The control unit 6 and lead 6*a* are covered by the sealing resin 7 made of a viscous liquid material, and a contact portion 10 between the substrate 2 and the print substrate 5 is covered by the sealing resin 7 prior to curing.

As shown in FIG. 2, since the head substrate 2 is not warped, the heating elements 4 are formed in a straight line without warpage.

The thermal head 1, covered with the sealing resin 7, is put in a high temperature environment to cure the sealing resin 7.

The sealing resin 7 contracts at the time of curing, such that the central portion of the head substrate 2 is warped towards a direction away from the cross section of the print substrate 5 as shown in FIG. 3. As a result, the head substrate 2 bulges out in plan view. The heating element 4 is warped by a warpage amount of $\beta$ as shown in FIG. 3.

The curing condition of the sealing resin 7 includes material, the amount of coating, heating temperature and heating time, or a combination thereof. The curing condition is set such that the heating element 4 is warped by a warpage amount $\alpha$ of 20 to 60 μm.

When the temperature of the heating elements 4 increases to a temperature where ink of an ink ribbon is sublimed or melted, the central portion of the head substrate 2 is warped in a direction away from the cross section of the print substrate 5, as shown in FIG. 4, such that the head substrate 2 is formed in a concave shape in plan view, even though a portion where the heating elements 4 are formed is thermally expanded and the head substrate 2 is fixed to the print substrate 5 with the sealing resin 7 and fixed to the head mounting member 8 with the adhesives. This is referred to as 'banana warpage' in the art.

The heating element 4 is warped by a warpage amount of $\alpha$ as shown in FIG. 4. The warpage of the head substrate 2 correlates with the energy being input to the heating element 4 and the warpage amount $\alpha$ as shown in FIG. 6. As the energy increases, the warpage amount $\alpha$ increases.

Accordingly, when the input energy is set, the warpage amount $\alpha$ can be set in advance from the graph shown in FIG. 6.

The energy input to the heating element 4 varies depending on the kind of ink ribbon, and the like. However, when the input energy is determined depending on the kind of ink ribbon and the like, the warpage amount $\alpha$ can be calculated.

Thus, when the curing condition of the sealing resin 7 varies to correspond to the banana warpage amount $\alpha$ occurring at the time of heat emission of the heating element 4, the concave warpage of the head substrate 2 occurring at the time of heat emission of the heating element 4 can be offset by the convex warpage of the head substrate 2 occurring at the time of curing of the sealing resin 7. As a result, it is possible to form the plurality of heating elements 4 in a straight line for the printing operation.

Accordingly, when a straight line is printed on a record paper, it is possible to emit heat of a plurality of heating elements 4 at the same time, and to conveniently control the heat emission by the control unit 6 composed of driver IC.

In addition, even though the head substrate 2 has a width D of 3 mm or less, a plurality of heating elements 4 can be formed in a straight line. Accordingly, ink ribbons and record papers can be uniformly pressed to the heating elements 4 by the platen roller 10.

Accordingly, it is possible to effectively sublime or heat-transfer ink of the ink ribbons onto the record papers, resulting in high-quality image printing.

As apparent from the above description, both ends of the head substrate in a longitudinal direction are warped in convex shape to a direction away from the cross section of the print substrate when the sealing resin is cured, and a central portion of the head substrate in a longitudinal direction is warped in concave shape to a direction away from the cross section of the print substrate when the heating elements emit heat, and a curing condition of the sealing resin is changed corresponding to the amount of the warpage occurring when the heating elements emit heat, such that the amount of warpage of the head substrate occurring when the head substrate is warped in convex shape is offset by the amount of warpage of the head substrate occurring when the sealing resin is cured, and the heating elements are arranged in a straight line when the heating elements emit heat. As a result, the heat emission of the heating elements may be controlled by means of the control unit.

In addition, the curing condition of the sealing resin includes material of the sealing resin, the coating amount of the sealing resin, heating temperature, heating time, or a combination thereof, such that the curing condition of the sealing resin is changed corresponding to the amount of warpage of the head substrate occurring when the heating elements emit heat. As a result, the curing condition of the sealing resin may be controlled, thereby facilitating the manufacture of the thermal head.

Further, the curing condition of the sealing resin is set such that the amount of warpage of the head substrate occurring when the sealing resin is cured is in a range of 20 to 60 μm.

Although only a few exemplary embodiments of this invention have been described in detail above, those skilled in the art will readily appreciate that many modifications are possible in the exemplary embodiments without materially departing from the novel teachings and advantages of the invention. Accordingly, all such modifications are intended to be included within the scope of this invention as defined in the following claims.

What is claimed is:

1. A method of manufacturing a thermal head having a head substrate on which a plurality of heating elements is arranged in a longitudinal direction thereof, comprising:

mounting a control unit on a print substrate so as to control heat emission of the heating elements; and covering the control unit, a cross section of the print substrate, and a cross section of the head substrate with a sealing resin;

wherein the print substrate and the head substrate are mounted on a head mounting, and both ends of the head substrate in a longitudinal direction are warped in a direction away from the cross section of the print substrate when the sealing resin is cured;

a central portion of the head substrate in a longitudinal direction is warped in a direction away from the cross section of the print substrate when the heating elements emit heat, and a curing condition when curing the sealing resin is such that the convex-shaped warpage of the head substrate occurring when the sealing resin is cured is offset by the concave-shaped warpage of the head substrate when the heating elements emit heat.

2. The method according to claim 1, wherein the curing condition of the sealing resin is obtained by changing at least one of a resin material, a coating amount, heating temperature, or heating time.

3. The method according to claim 2, wherein the curing condition of the sealing resin is such that the amount of the concave-shaped warpage of the head substrate occurring when the sealing resin is cured is in a range of about 20 to about 60 μm.

* * * * *